US011437772B1

(12) United States Patent
Wood, Jr.

(10) Patent No.: US 11,437,772 B1
(45) Date of Patent: Sep. 6, 2022

(54) DEVICE FOR MANAGING FENCING

(71) Applicant: James Alexander Wood, Jr., Scottsville, VA (US)

(72) Inventor: James Alexander Wood, Jr., Scottsville, VA (US)

( * ) Notice: Subject to any disclaimer, the term of this patent is extended or adjusted under 35 U.S.C. 154(b) by 316 days.

(21) Appl. No.: 16/904,968

(22) Filed: Jun. 18, 2020

(51) Int. Cl.
*B25B 27/00* (2006.01)
*H01R 43/042* (2006.01)

(52) U.S. Cl.
CPC ..... *H01R 43/042* (2013.01); *Y10T 29/53909* (2015.01)

(58) Field of Classification Search
CPC .. H01R 43/042; H01R 43/058; H01R 43/048; B25F 1/04; B25B 27/146; B25B 25/00; B25B 5/04; Y10T 29/49181; Y10T 29/53257; Y10T 29/5151; Y10T 29/53222; Y10T 29/53235; Y10T 29/53909; Y10T 29/53996
USPC ..... 29/270, 281.6, 268, 278, 283, 434, 758
See application file for complete search history.

(56) References Cited

U.S. PATENT DOCUMENTS 6,807,961 B2 * 10/2004 Burrows ..... B28D 1/223 30/252
9,296,116 B2 * 3/2016 Descombes ..... B26B 17/02

* cited by examiner

*Primary Examiner* — Thiem D Phan
(74) *Attorney, Agent, or Firm* — Dale Jensen, PLC; Dale Jensen

(57) ABSTRACT

Certain exemplary embodiments can provide a device comprising a pair of handles, and a set of prongs. The pair of jaws is coupled to the pair of handles. The set of prongs is coupled to the pair of jaws. The set of prongs comprises a pair of prongs coupled to a first jaw of the pair of jaws. The set of prongs comprises a single prong coupled to a second jaw of the pair of jaws. The device, via the set of prongs is constructed to crimp a wire as the pair of handles is closed.

6 Claims, 9 Drawing Sheets

1000

7000

7000

DEVICE FOR MANAGING FENCING

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a device comprising a pair of handles, and a set of prongs. The pair of jaws is coupled to the pair of handles. The set of prongs is coupled to the pair of jaws. The set of prongs comprises a pair of prongs coupled to a first jaw of the pair of jaws. The set of prongs comprises a single prong coupled to a second jaw of the pair of jaws. The device, via the set of prongs is constructed to crimp a wire as the pair of handles is closed.

Figures 1A, 1B:
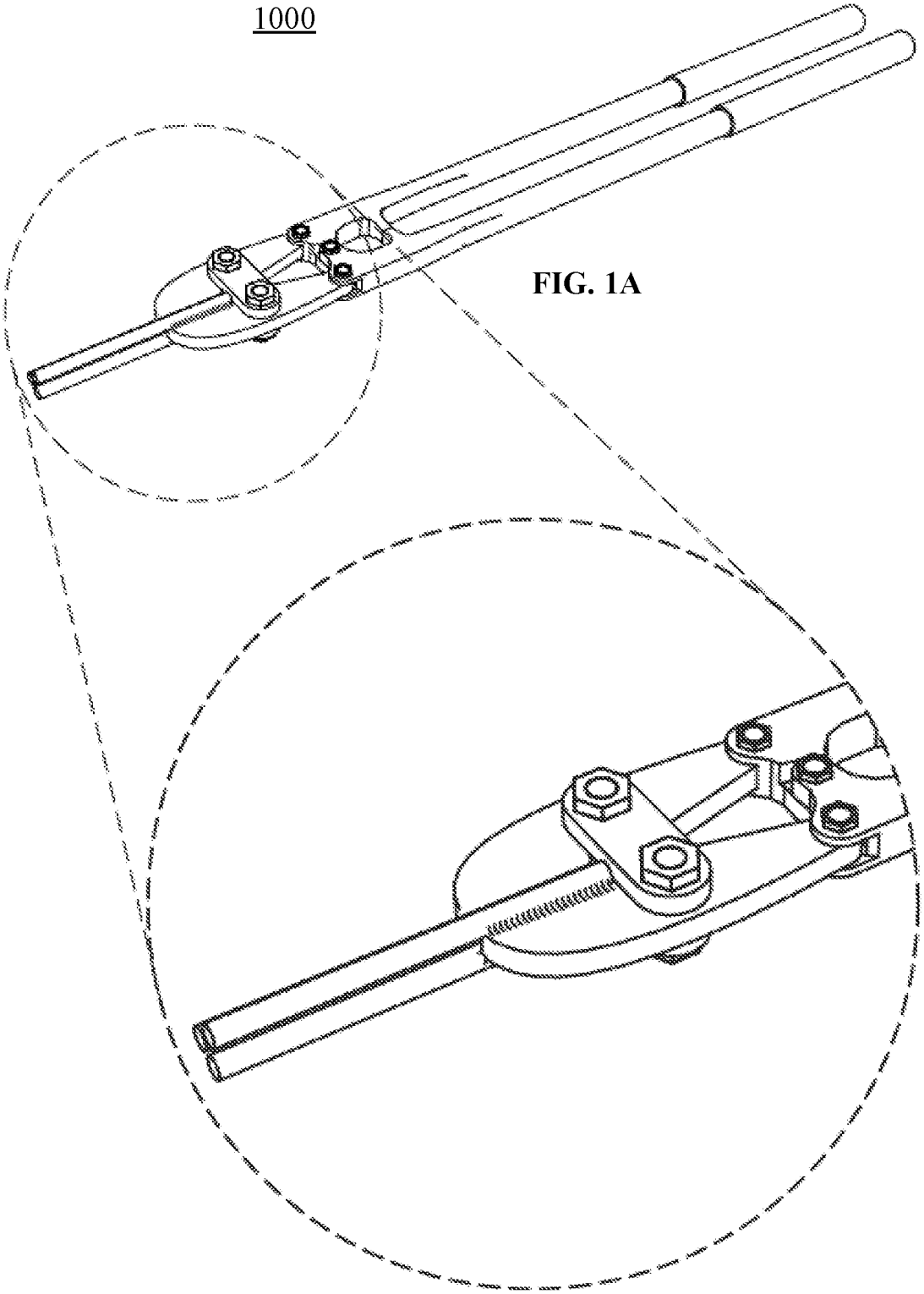
FIG. 1A is a perspective view of an exemplary embodiment of a device 1000.
FIG. 1B is a magnified view of a portion of device 1000.

FIG. 1A is a perspective view of an exemplary embodiment of a device 1000.

FIG. 1B is a magnified view of a portion of device 1000.

Figure 2A:
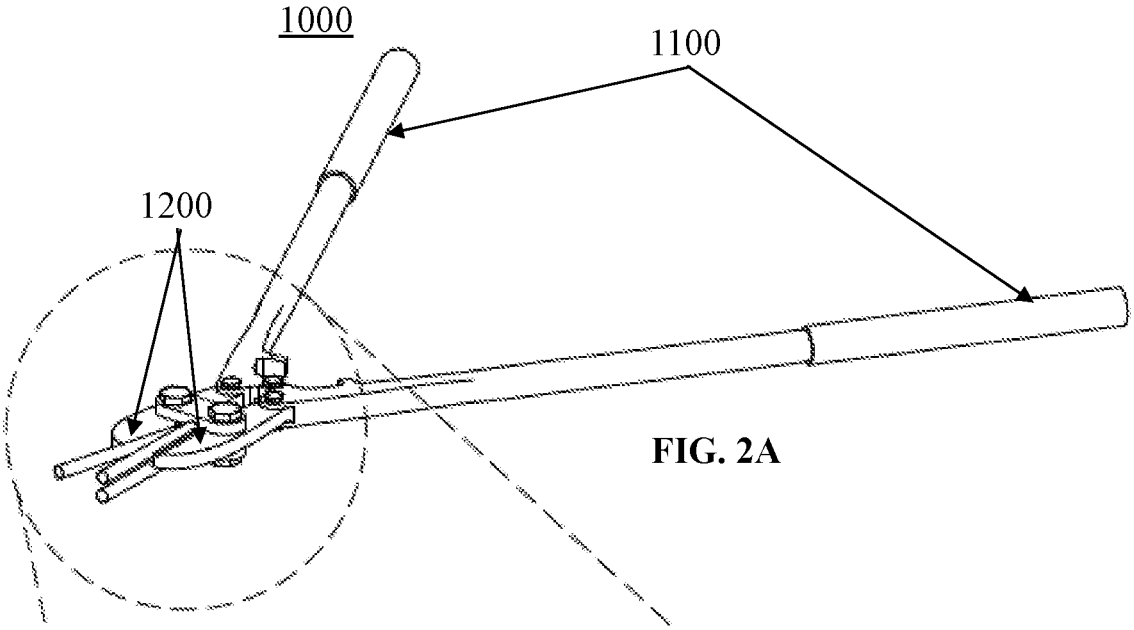
FIG. 2A is a perspective view of device 1000.
Figure 2B:
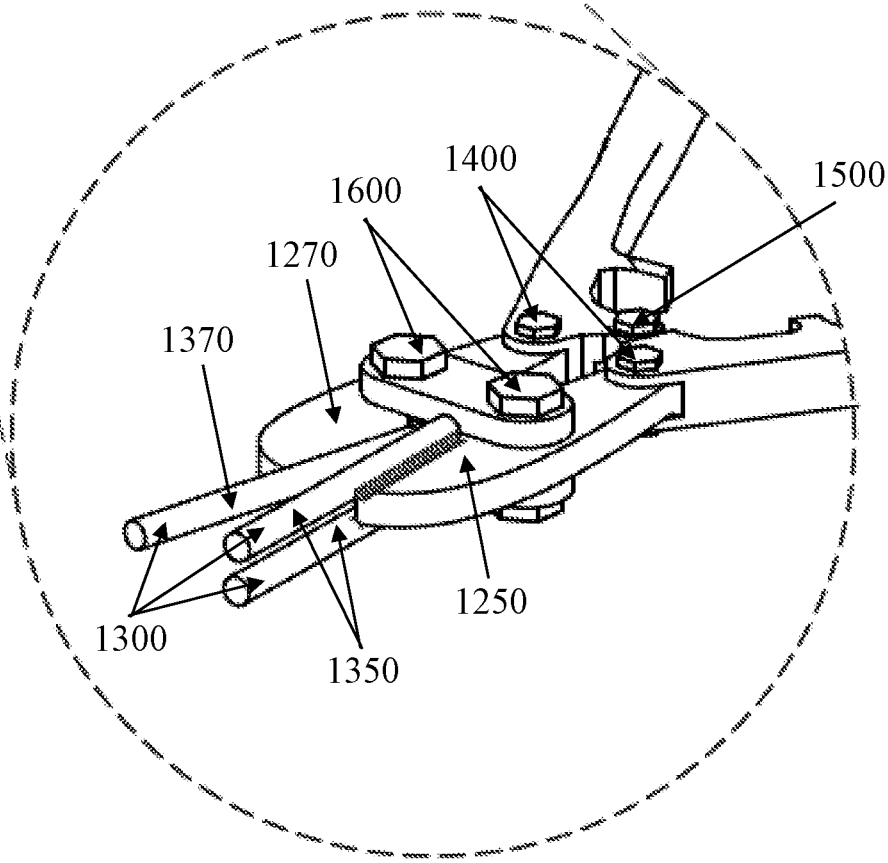
FIG. 2B is a magnified view of a portion of device 1000.

FIG. 2A is a perspective view of device 1000. FIG. 2B is a magnified view of a portion of device 1000. Device 1000 comprises a pair of handles 1100, a pair of jaws 1200, and a set of prongs 1300. Pair of jaws 1200 is coupled to pair of handles 1100. Set of prongs 1300 is coupled to pair of jaws 1200. Set of prongs 1300 comprises a pair of prongs 1350 coupled to a first jaw 1250 of pair of jaws 1200. Set of prongs 1300 comprises a single prong 1370 coupled to a second jaw 1270 of the pair of jaws.

In certain exemplary embodiments, set of prongs 1300 is welded to pair of jaws 1200. In certain exemplary embodiments, set of prongs 1300 is cast as a single unit with pair of jaws 1200. In certain exemplary embodiments, set of jaws 1200 is releasably coupled to pair of handles 1100. In certain exemplary embodiments, set of jaws 1200 is releasably coupled to pair of handles 1100 via a set of fasteners 1400 and a hinge 1500. In certain exemplary embodiments, first jaw 1250 is coupled to second jaw 1270 via a set of fasteners 1600.

A length of set of prongs 1300 can be varied. In certain exemplary embodiments, set of prongs 1300 can be significantly shorter relative a length of pair of jaws 1200 than is illustrated in device 1000 as illustrated herein. In certain exemplary embodiments, set of prongs 1300 can be shortened up to set of jaws 1200.

Figure 3:
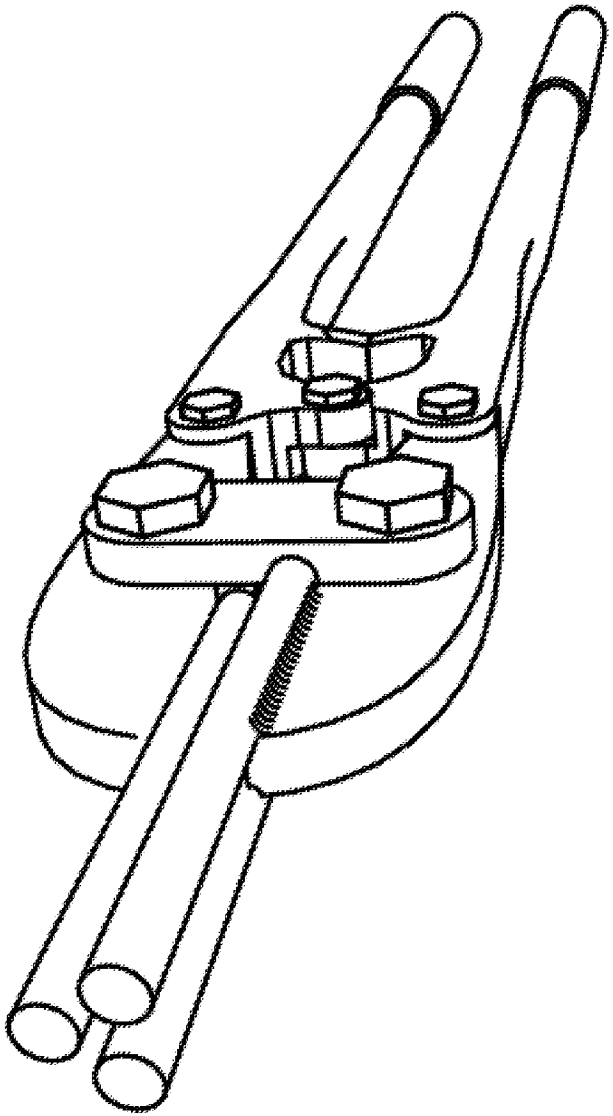
FIG. 3 is a perspective view of device 1000.

FIG. 3 is a perspective view of device 1000.

Figure 4:
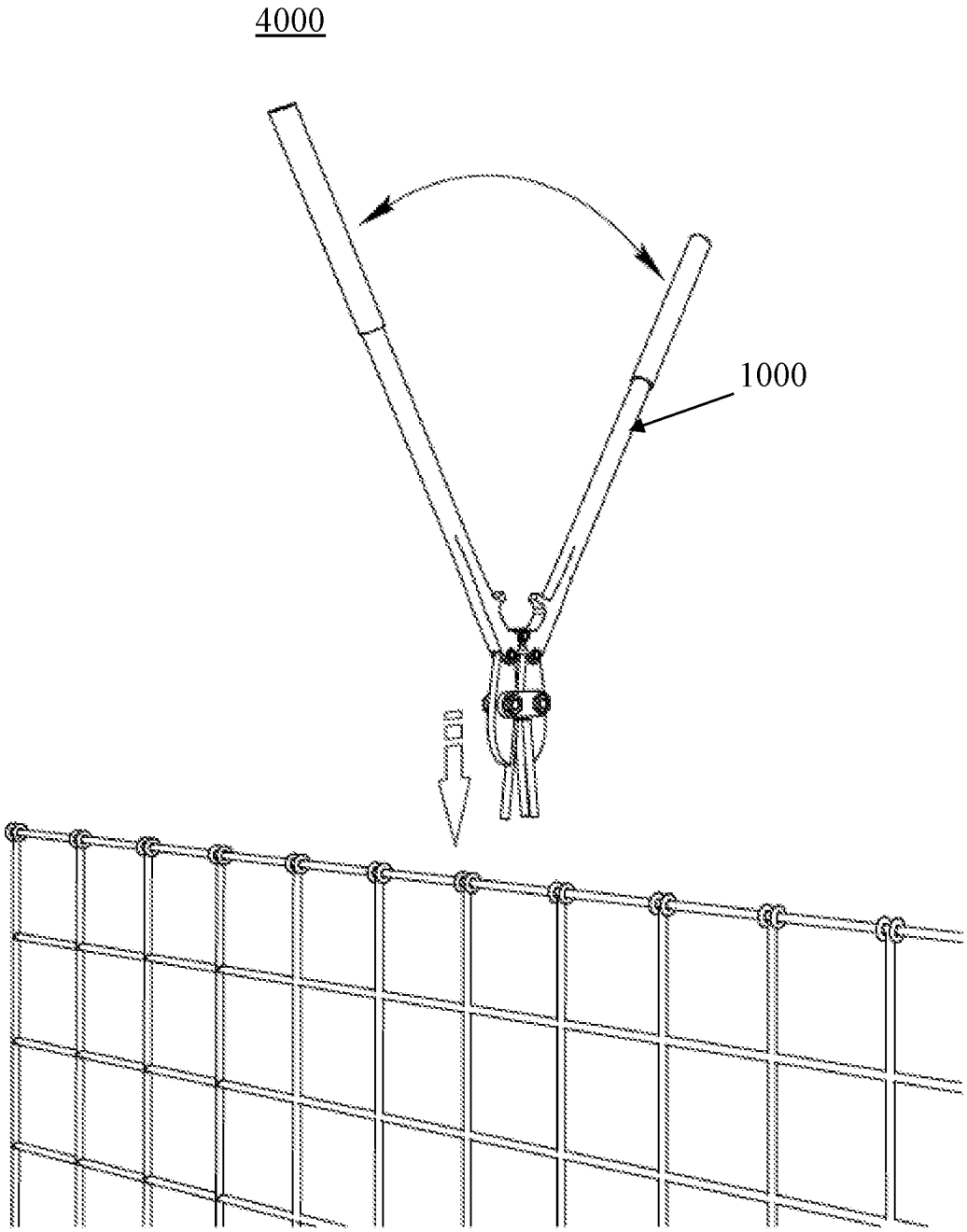
FIG. 4 is a perspective view of an exemplary embodiment of a system 4000, which comprises device 1000.

FIG. 4 is a perspective view of an exemplary embodiment of a system 4000, which comprises device 1000.

Figure 5:
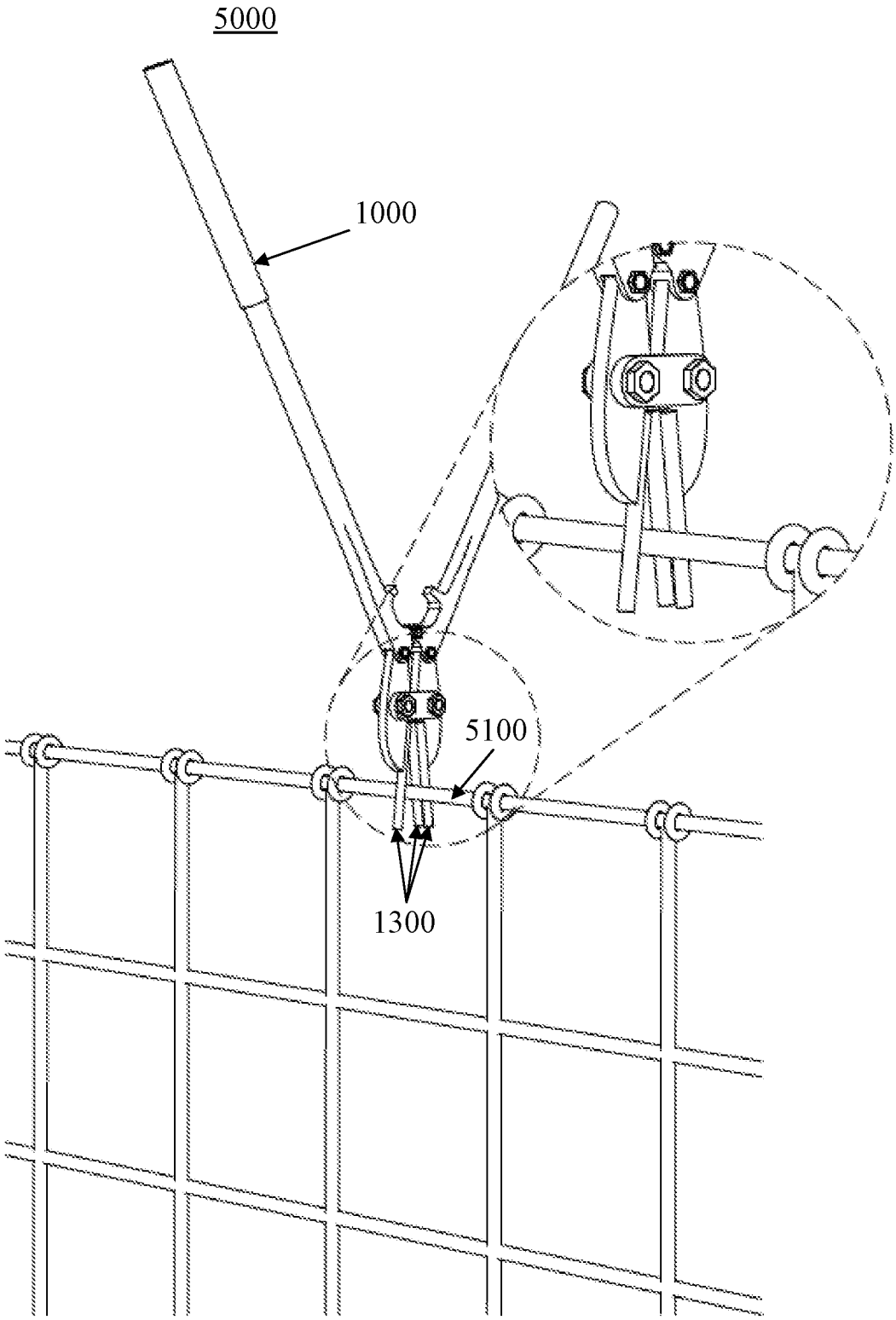
FIG. 5 is a perspective view of an exemplary embodiment of a system 5000, which comprises device 1000.

FIG. 5 is a perspective view of an exemplary embodiment of a system 5000, which comprises device 1000. As illustrated, device 1000, via set of prongs 1300, is constructed to crimp a wire 5100 as the pair of handles is closed.

Figure 6:
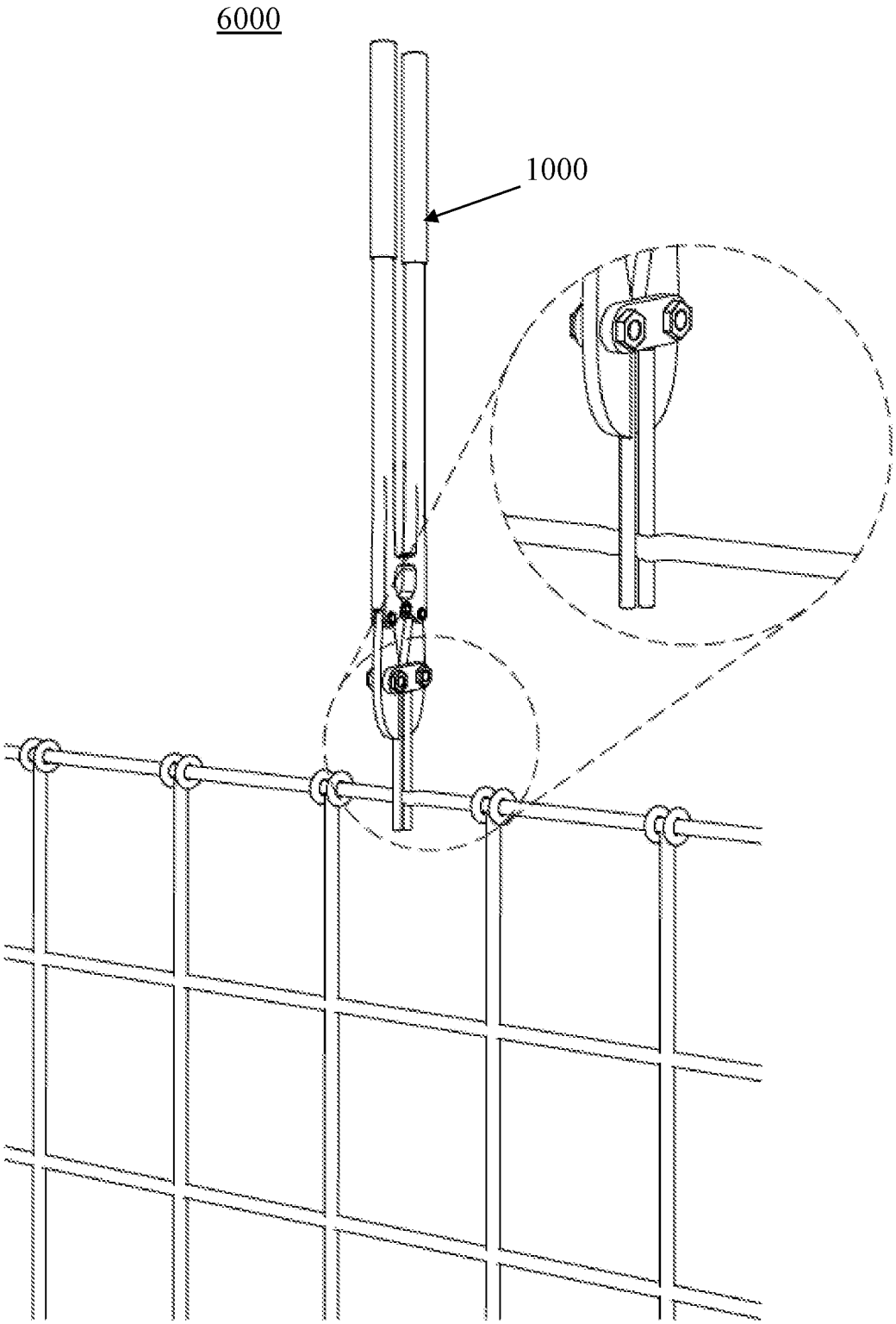
FIG. 6 is a perspective view of an exemplary embodiment of a system 6000, which comprises device 1000.
Figure 7A:
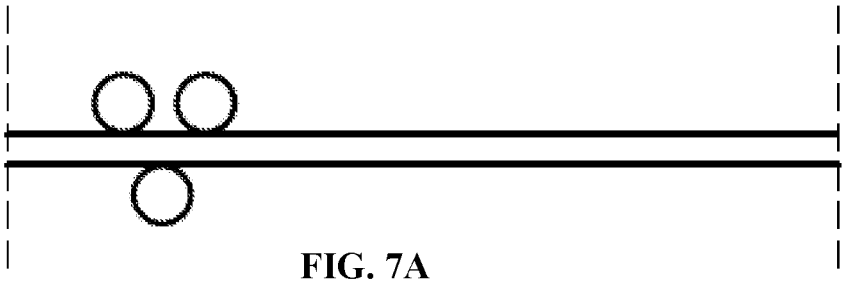
FIGS. 7A, 7B, 7C, and 7D are block diagrams of an exemplary embodiment of a system 7000.
Figure 7B:
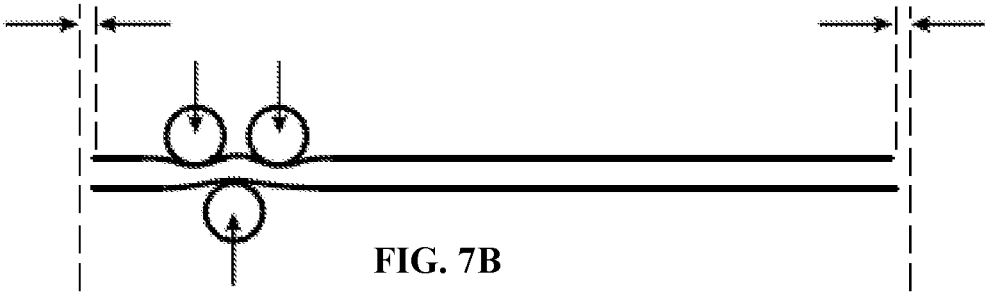
Figure 7C:
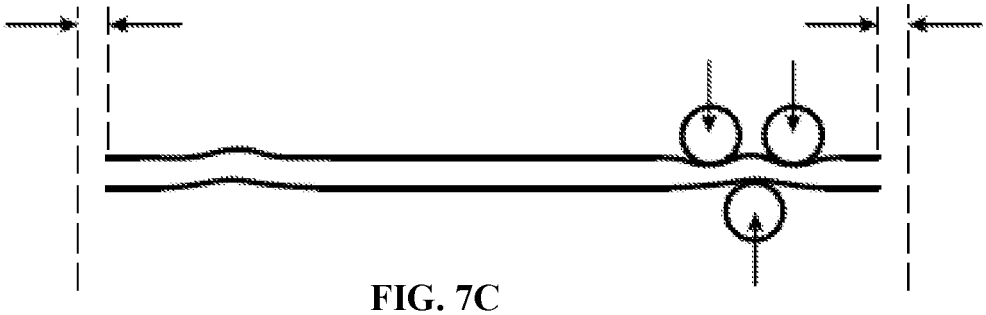
Figure 7D:
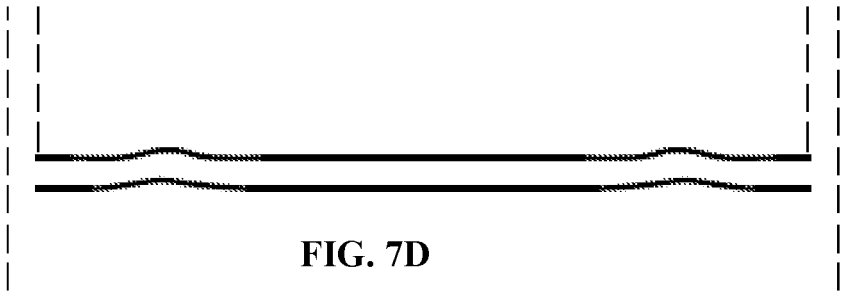

FIG. 6 is a perspective view of an exemplary embodiment of a system 6000, which comprises device 1000.

FIGS. 7A, 7B, 7C, and 7D are block diagrams of an exemplary embodiment of a system 7000.

Figures 8A, 8B:
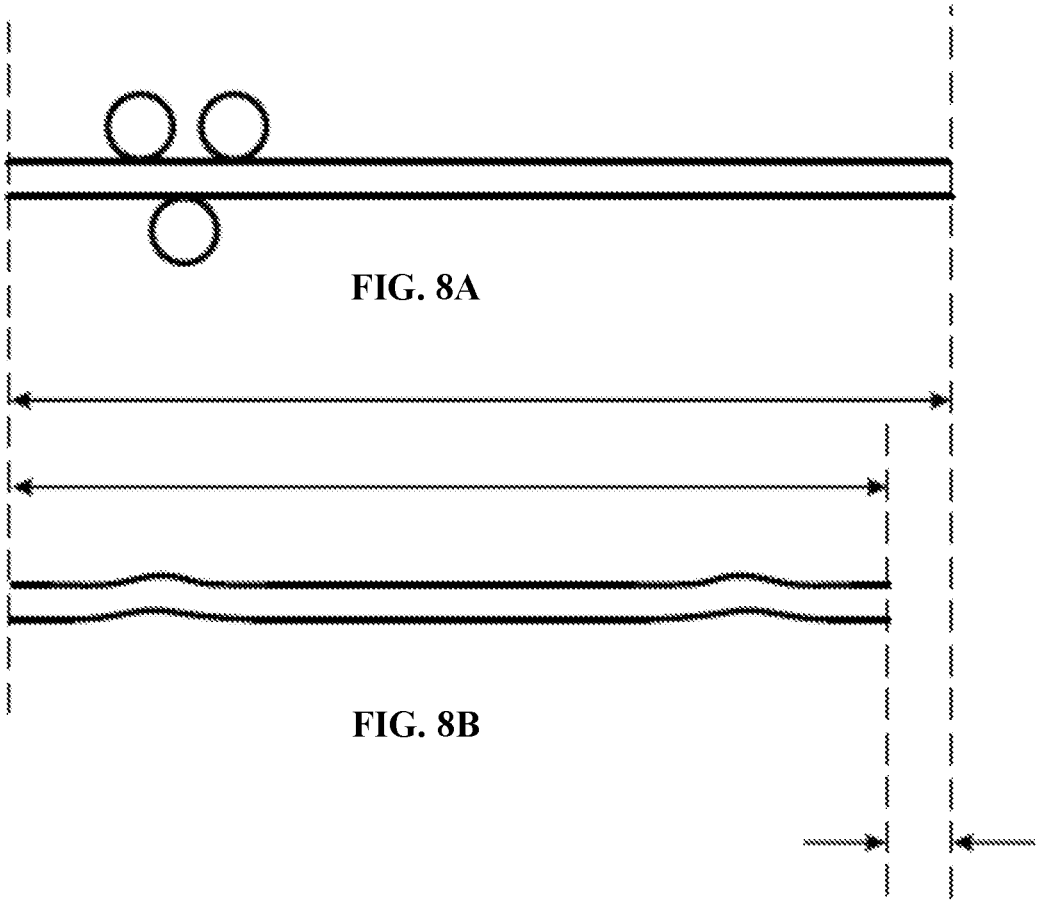
FIGS. 8A and 8B are block diagrams of system 7000.

FIGS. 8A and 8B are block diagrams of system 7000.

Figure 9:
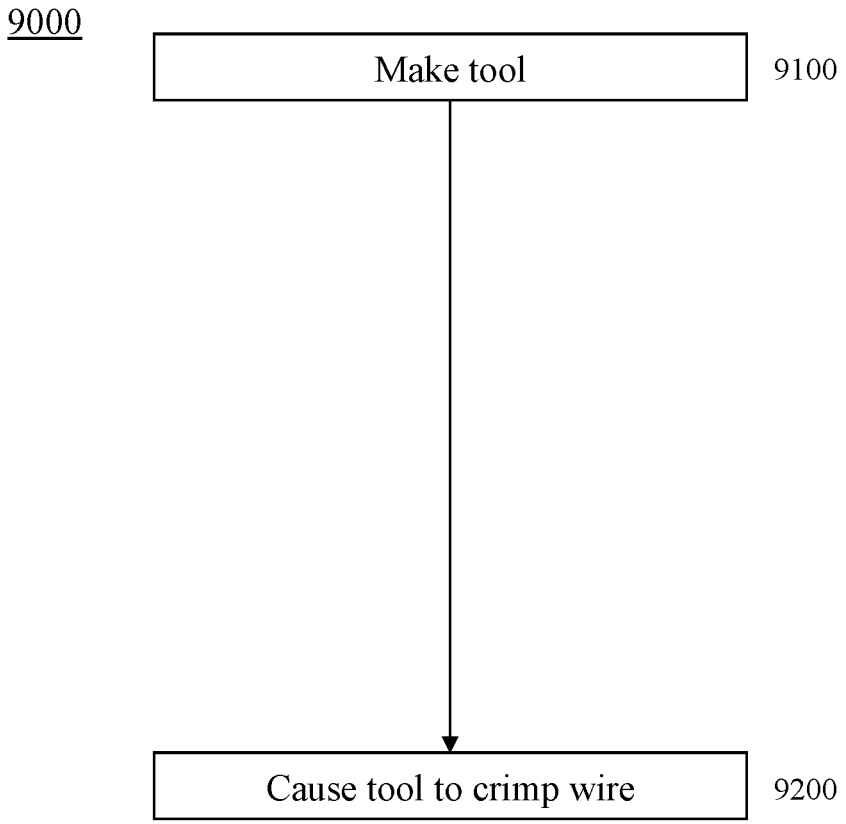
FIG. 9 is a flowchart of an exemplary embodiment of a method 9000.

FIG. 9 is a flowchart of an exemplary embodiment of a method 9000.

At activity 9100, a tool is made. The tool comprises:

a pair of handles;

a pair of jaws coupled to the pair of handles; and a set of prongs coupled to the pair of jaws, the set of prongs comprising a pair of prongs coupled to a first jaw of the pair of jaws, the set of prongs comprising a single prong coupled to a second jaw of the pair of jaws.

The device, via the set of prongs, is constructed to crimp a wire as the pair of handles is closed.

At activity 9200, certain exemplary embodiments cause the tool to crimp the wire.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

and/or—either in conjunction with or in alternative to.

apparatus—an appliance or device for a particular purpose associate—to join, connect together, and/or relate.

can—is capable of, in at least some embodiments.

cast—to form by pouring a liquid into a mold in which the liquid solidifies.

cause—to produce an effect.

close—to press handles together.

comprising—including but not limited to.

configure—to make suitable or fit for a specific use or situation.

connect—to join or fasten together.

constructed to—made to and/or designed to.

convert—to transform, adapt, and/or change.

couple—to link in some fashion.

coupleable—capable of being joined, connected, and/or linked together.

create—to bring into being.

crimp—to cause something to bend.

define—to establish the outline, form, or structure of determine—to obtain, calculate, decide, deduce, and/or ascertain.

device—a machine, manufacture, and/or collection thereof.

fastener—one (or more) restraints that attach to, extend through, penetrate, and/or hold something. For example, a fastener can be one (or more) bolt and nut assembly, rivet, weldment, nail, screw, peg, staple, clip, buckle, clasp, clamp, hook and loop assembly, adhesive, and/or plastic push rivet, etc.

handle—a part of a thing sized and/or shaped specifically to be grasped or held by a hand of a user.

hinge—a mechanical bearing that connects two components, which allows rotation between the two components.

install—to connect or set in position and prepare for use.

jaws—two opposing surfaces that are constructed to grip objects.

may—is allowed and/or permitted to, in at least some embodiments.

method—a process, procedure, and/or collection of related activities for accomplishing something.

pair—two similar things used together.

plurality—the state of being plural and/or more than one.

predetermined—established in advance.

prong—a projecting part of an object.

provide—to furnish, supply, give, and/or make available.

receive—to get as a signal, take, acquire, and/or obtain.

repeatedly—again and again; repetitively.

request—to express a desire for and/or ask for.

select—to make a choice or selection from alternatives.

set—a related plurality.

store—to place, hold, and/or retain.

substantially—to a great extent or degree.

support—to bear the weight of, especially from below.

system—a collection of mechanisms, devices, machines, articles of manufacture, processes, data, and/or instructions, the collection designed to perform one or more specific functions.

transmit—to send, provide, furnish, and/or supply.

via—by way of and/or utilizing.

weld—to fuse a material by heating.

wire—metal drawn out into the form of a thin flexible thread or rod.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A device comprising:

a pair of handles;

a pair of jaws coupled to the pair of handles; and a set of prongs coupled to the pair of jaws, the set of prongs comprising a pair of prongs coupled to a first jaw of the pair of jaws, the set of prongs comprising a single prong coupled to a second jaw of the pair of jaws; wherein the device, via the set of prongs, is constructed to crimp a wire as the pair of handles is closed.

2. The device of claim 1, wherein:

the set of prongs is welded to the pair of jaws.

3. The device of claim 1, wherein:

the set of prongs is cast as a single unit with the pair of jaws.

4. The device of claim 1, wherein:

the set of jaws is releasably coupled to the pair of handles.

5. The device of claim 1, wherein:

the set of jaws is releasably coupled to the pair of handles via a set of fasteners and a hinge.

6. The device of claim 1, wherein:

the first jaw is coupled to the second jaw via a set of fasteners.

* * * * *